US006737794B2

(12) United States Patent
Lee

(10) Patent No.: US 6,737,794 B2
(45) Date of Patent: May 18, 2004

(54) CATHODE RAY TUBE

(75) Inventor: Gyung-Sang Lee, Kumi (KR)

(73) Assignee: LG Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/350,108

(22) Filed: Jan. 24, 2003

(65) Prior Publication Data

US 2004/0041510 A1 Mar. 4, 2004

(30) Foreign Application Priority Data

Sep. 4, 2002 (KR) ..... 10-2002-0053074

(51) Int. Cl.[7] ..... H01J 1/46
(52) U.S. Cl. ..... 313/346; 313/270
(58) Field of Search ..... 313/346, 270

(56) References Cited

U.S. PATENT DOCUMENTS 5,552,661 A 9/1996 Lee

FOREIGN PATENT DOCUMENTS

JP 6-267400 * 9/1994
KR 2001-0015015 A 2/2001

* cited by examiner

*Primary Examiner*—Vip Patel
(74) *Attorney, Agent, or Firm*—Birch, Stewart, Kolasch & Birch LLP

(57) ABSTRACT

A cathode ray tube having a cathode comprising a sleeve with a heater. installed therein and a base metal with a side portion covering an outer circumference of the sleeve and an upper surface portion covering an upper side: of the sleeve, satisfies the following formula: $t_S \leqq t_{B1} \leqq 2t_S$, wherein $t_{B1}$ is a thickness of the side portion of the base metal and $t_S$ is a thickness of the sleeve. Therefore, the warm-up time taken for formation of an image after power is applied to the cathode ray tube can be shortened.

8 Claims, 4 Drawing Sheets

CATHODE RAY TUBE

BACKGROUND OF THE INVENTION

1. Field of the Invention

The present invention relates to a cathode ray tube, and more particularly, to a cathode of a cathode ray tube that is capable of shortening a warm-up time taken for formation of an image after power is applied to a cathode ray tube by optimally designing a configuration of a cathode of the cathode ray tube.

2. Description of the Background Art

In general, a cathode ray tube is a device to optically implement an image by converting an electric signal to an electron beam and emitting the electron beam to a fluorescent surface. With its excellent display quality compared to its price, the cathode ray tube is favored and widely used.

The cathode ray tube will now be described with reference to the accompanying drawings.

FIG. 1 is view showing a structure of a general cathode ray tube.

As shown in FIG. 1, a general cathode ray tube includes a panel 15, a front glass; a funnel 19, a rear glass, coupled with the panel 15 to form a vacuous space; a fluorescent surface 14 coated at an inner side of the panel and serving as a luminescent material; an electron gun 100 for emitting electron beam 13; a deflection yoke 18 mounted at a position spaced apart from an outer circumferential surface of the funnel 19 and deflecting the electron beam 13 toward the fluorescent surface 14; and a shadow mask 17 installed spaced apart from the fluorescent surface 14.

As shown in FIG. 2, the electron gun 100 includes a cathode 3 generating the electron beam 13 as a heater 2 inserted therein generates heat; a first electrode 4, a control electrode, being disposed at a distance from the cathode 3 and controlling the electron beam 13; a second electrode 5, an accelerating electrode, disposed with a certain space from the first electrode 4 and accelerating the electron beam 13; third electrode 6, fourth electrode 7, fifth electrode 8, sixth electrode 9 and seventh electrode 10 for focusing or accelerating a portion of the electron beam; and a shield cup 11 having a bulb space connector (BSC) which fixes the electron gun 100 to a neck part of the cathode ray tube while electrically connecting the electron gun 100 and the cathode ray tube.

Accordingly, the electron beam 13 is generated from the surface of the cathode 3 by the heat of the heater heated upon receiving power from a stem pin 1, controlled by the first electrode 4, accelerated by the second electrode 5, and focussed or accelerated by the third electrode 6, the fourth electrode 7, the fifth electrode 8, the sixth electrode 9 and the seventh electrode 10, and then emitted toward the fluorescent surface 14 of the panel.

The cathode generating the electron beam will now be described in detail with reference to FIG. 3.

FIG. 3 is a sectional view of the cathode of the cathode ray tube in accordance with the conventional art.

In the conventional cathode ray tube, the cathode 3 includes a cylindrical sleeve 136 having a heater 2 insertedly installed therein; a base metal 135 fixed at an upper end of the sleeve 136, containing a very small amount of reducing agent such as silicon (Si) or magnesium (Mg) and having nickel (Ni) as a main constituent; and an electron emissive layer 131 attached at the upper end of the base metal 135, and comprising an alkaline earth metal oxide such as strontium (Sr) or calcium (Ca) and having barium (Ba) as a main constituent.

The sleeve 136 includes a blackening layer (not shown) having a high thermal radiation rate formed at its inner circumferential surface for increasing a heat transfer by radiation.

The base metal 135 contains 0.02~0.04 wt % silicon (Si) and 0.035~0.065 wt % (a very small amount) magnesium (Mg), the reducing agents.

The operation that electrons are generated in the cathode of the cathode ray tube constructed as described above in accordance with the conventional art will now be explained.

First, as the heater 2 insertedly installed in the sleeve 136 is heated, thermochemical reaction takes place between Barium oxide (BaO), the main constituent of the electron emissive layer 131, and the reducing agents such as silicon (Si) and magnesium (Mg) in the base metal 135. This results in generation of free barium.

At this time, electrons are generated from the free barium, and thermochemical reaction equations of the electron generation are as follows:

$$BaCO_3(\text{heated})=BaO+CO_2 \quad (1)$$

$$4BaO+Si=2Ba+Ba_2SiO_4 \quad (2)$$

$$2BaO+Si=Ba+SiO_2 \quad (3)$$

$$BaO+Mg=Ba+MgO \quad (4)$$

$$Ba+Ba^{2+}+2e^{-}(\text{electron}) \quad (5)$$

Meanwhile, recently, as the cathode ray tube is in the tendency of being large-scaled in its size, a cathode current load density is increased to accelerate reduction of the reducing agents such as silicon (Si) and magnesium (Mg) in the base metal 135 which are diffused and supplied to the electron emissive layer 131, shortening the life span of the cathode 3. Therefore, in order to provide a long life span cathode to the cathode ray tube, the thickness ($t_B$) of the base metal 135 is set thick.

That is, the cathode 3 of the conventional cathode ray tube has used a thin base metal 135 with a thickness of 0.5 mm, but a cathode of the recent cathode ray tube with a high cathode current load density uses a base metal 135 with a thickness of up to 0.25 mm to extend the life span of the cathode ray tube.

However, the thickening of the base metal 135 causes lengthening of time for generating electron beams 13 in the cathode 3. As a result, a warm-up time taken for formation of an image after power is applied to the cathode ray tube is delayed.

SUMMARY OF THE INVENTION

Therefore, an object of the present invention is to provide a cathode of a cathode ray tube that is capable of shortening time taken for implementing an image after power is applied to a cathode ray tube by quickly transmitting heat generated from a heater to an electron emissive layer by providing an optimum combination of a thickness of a base metal and a thickness of a sleeve of a cathode.

To achieve these and other advantages and in accordance with the purpose of the present invention, as embodied and broadly described herein, there is provided a cathode ray tube having a cathode, the cathode comprising a sleeve with a heater installed therein and a base metal with a side portion covering an outer circumference of the sleeve and an upper surface portion covering an upper side of the sleeve, satisfies the following formula:

$$t_S \leq t_{B1} \leq 2t_S$$

wherein $t_{B1}$ is a thickness of the side portion of the base metal and $t_S$ is a thickness of the sleeve.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A cathode of a cathode ray tube in accordance with the present invention will now be described with reference to FIGS. 4A, 4B and 5.

Figure 1:
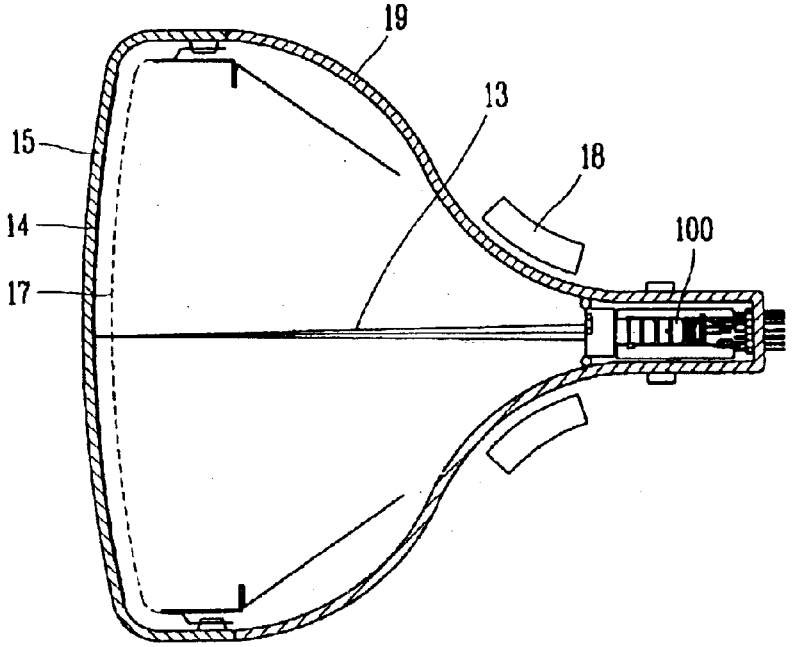
FIG. 1 CONVENTIONAL ART
FIG. 1 is a schematic view of a general cathode ray tube.
Figure 2:
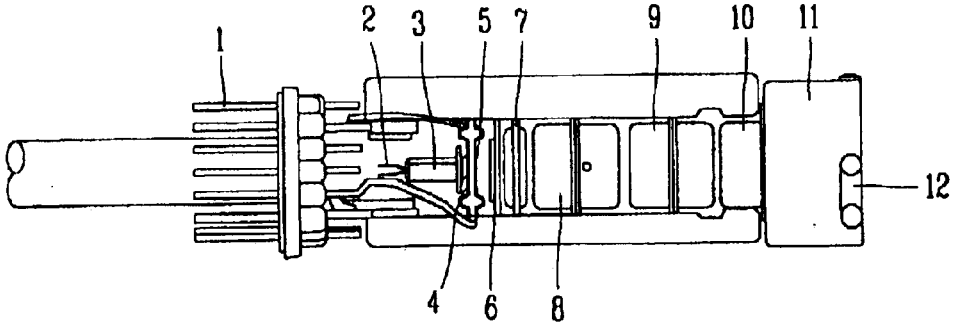
FIG. 2 CONVENTIONAL ART
FIG. 2 is a schematic view of an in-line type electron gun for the general cathode ray tube.
Figure 3:
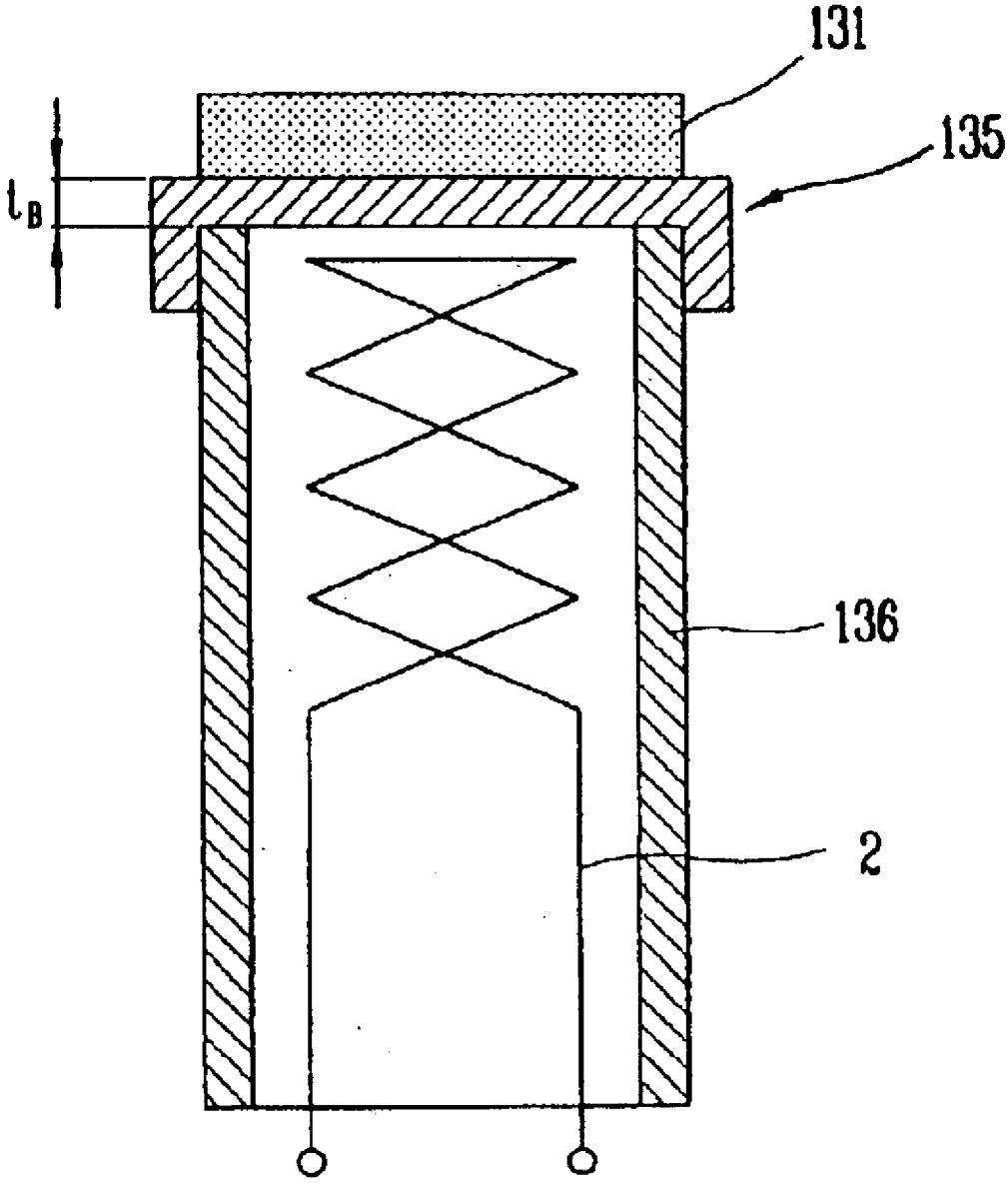
FIG. 3 CONVENTIONAL ART
FIG. 3 is a sectional view of a cathode of a cathode ray tube in accordance with a conventional art.
Figure 4A:
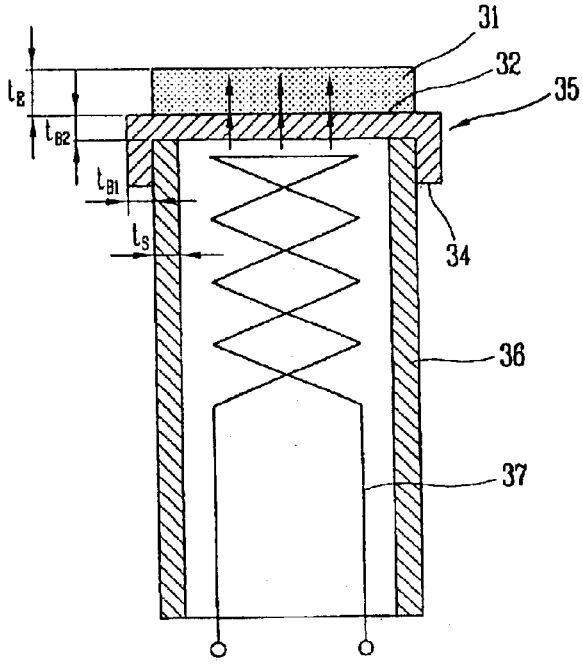
FIG. 4A is a sectional view showing a cathode of a cathode ray tube and a thermal conduction direction in the cathode in accordance with the present invention.
Figure 4B:
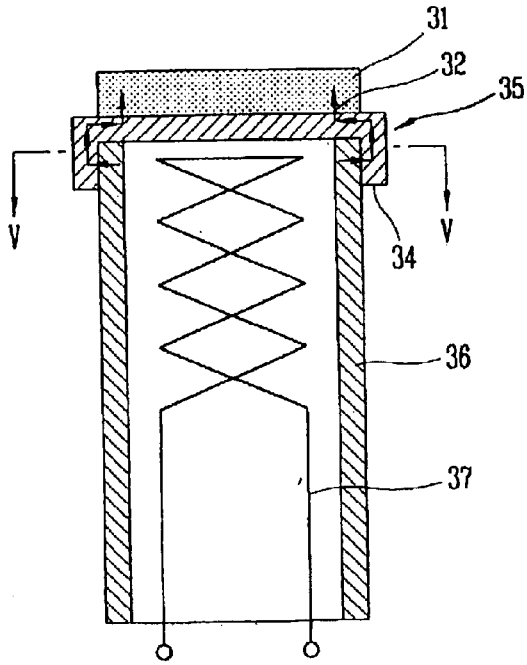
FIG. 4B is a sectional view showing a cathode of a cathode ray tube and a thermal conduction direction in the cathode in accordance with the present invention.
Figure 5:
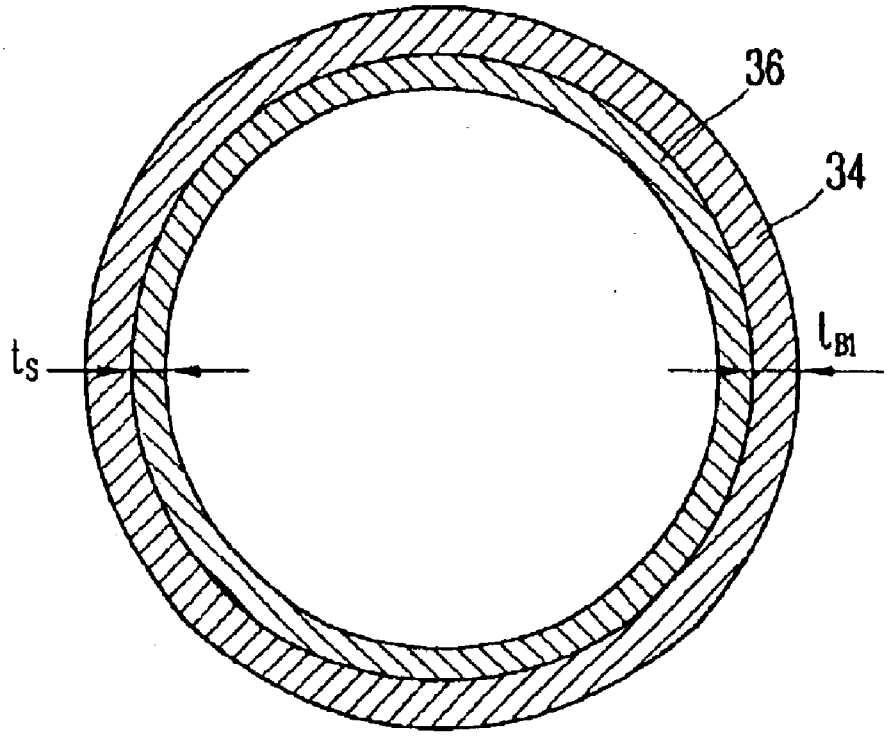
FIG. 5 is a sectional view taken along line V—V of FIG. 4B.

FIGS. 4A and 4B are sectional views showing a cathode of a cathode ray tube and a thermal conductivity direction in the cathode in accordance with the present invention; and FIG. 5 is a sectional view taken along line V—V of FIG. 4B.

A cathode 3 of a cathode ray tube of the present invention includes a cylindrical sleeve 16 having a heater 37 insertedly installed therein; a base metal 35 fixed at an upper end of the sleeve 36, containing a very small amount of reducing agent such as silicon (Si) or magnesium (Mg) and having nickel (Ni) as a main constituent; and an electron emissive layer 31 attached at the upper end of the base metal 35, and comprising an alkaline earth metal oxide such as strontium (Sr) or calcium (Ca) and having barium (Ba) as a main constituent.

The sleeve 36 includes a blackening layer with a high thermal radiation rate at its inner circumferential surface so as to satisfactorily transmit heat of the heater 37 toward the sleeve 36.

The base metal 35 is formed as a cap to cover the upper side of the sleeve 36, including a disk-type upper surface portion 32, and a cylindrical side portion 34 vertically extended from the circumference of the upper surface portion 32 and having an inner circumferential surface is tightly attached to an outer circumferential surface of the upper side of the sleeve 36.

The electron emissive layer 31 is formed with a certain thickness ($t_E$) at an upper side of the upper surface portion 32 of the base metal 35.

The operation that electrons are generated from the cathode of the cathode ray tube constructed as described above will now be explained.

First, as the heater 37 insertedly installed in the sleeve 36, a chemical reaction takes place between barium oxide of the electron emissive layer 31 and silicon (Si) and magnesium (Mg) in the base metal 35. This results in generation of free barium and electrons are generated from the free barium.

The process of transmitting heat generated from the heater 37 to the electron emissive layer 31 will now be described.

The heat of the heater 37 insertedly installed in the sleeve 36 is directly transmitted to the upper surface portion 32 of the base metal 35 as shown in FIG. 4A, or transmitted to the upper surface portion 32 of the base metal 35 through the sleeve 36 and the side portion 34 of the base metal 35 as shown in FIG. 4B, so as to be transmitted to the electron emissive layer 31.

Here, the time taken for the heat generated from the heater 37 to be transmitted to the electron emissive layer 31 determines a warm-up time taken for formation of an image after the cathode ray tube is turned on.

That is, the time taken for receiving heat sufficient for barium oxide in the electron emissive layer 31 to make a chemical reaction determines the time taken for the electron beams to be emitted from the electron emissive layer 31. Therefore, the greater the thermal conductivity of the sleeve 36 and the base metal 35 is, the faster the warm-up time is.

The warm-up time can be deduced from time taken for the electron emissive layer 31 to reach a requested temperature after power is applied, the time taken for current of the cathode to reach a requested current value, or the time taken for a screen brightness to reach a required brightness. The requested temperature, current value or brightness can be different in its use according to manufacturers.

In order to shorten the warm-up time, the present invention provides an is optimum designing range for the thickness ($T_{B1}$) of the side portion 34 of the base metal 35 and the thickness ($T_S$) of the sleeve 36 to heighten a thermal conductivity of the heat transmitted through the base metal 35 and the sleeve 36 so that the heat generated from the heater 37 can be quickly transmitted to the electron emissive layer 31.

In order for the heat of the heater 37 to be quickly transmitted to the electron emissive layer 31, the thickness ($t_{B2}$) of the upper surface portion 32 of the base metal 35 is formed thin or the thickness ($t_{B1}$) of the side portion 34 of the base metal 35 and the thickness ($t_S$) of the sleeve 36 are formed thin.

Namely, the heat transmission can be explained through the following thermal conduction relational expression:

$$Q/A = k \times \Delta T/L \tag{6}$$

The equation (6) represents a thermal conductivity of an object with a length of 'L' and a cross-sectional area of 'A', wherein Q/A is an amount of thermal conduction per unit area, 'k' is a heat conductivity indicating a degree of transmission of a thermal energy, and ΔT is an input/output temperature difference.

As noted in equation (6), the shorter the heat conduction distance (L), the more the amount of thermal conduction is increased. Thus, in order to quickly proceed with the thermal conduction, the thickness ($t_{B2}$) of the upper surface portion 32 of the base metal 35 is to be formed thin or the thickness ($t_S$) of the sleeve 36 and the thickness ($t_{B1}$) of the side portion 34 of the base metal 35 are to be formed thin.

At this time, reduction of the thickness ($t_{B2}$) of the upper surface portion 32 of the base metal 35 would reduce the amount of the reducing agent such as silicon (Si) and magnesium (Mg) contained in the base metal 35, resulting in a degradation of the life span of the cathode.

Therefore, in order to improve the thermal conductivity, it is preferred to reduce the thickness ($t_{B1}$) of the side portion 34, rather than reducing the thickness ($t_{B2}$) of the upper surface portion 32 of the base metal 35.

In this respect, however, if the thickness ($t_{B1}$) of the side portion 32 of the base metal 35 is reduced to be thinner than the thickness ($t_S$) of the sleeve 36, the heat generated from the heater 37 would be discharged downwardly of the sleeve 35, rather than being sufficiently transferred to the side portion 34 of the base metal 35, resulting in that heat loss occurs.

Accordingly, in the case that the thickness ($t_{B1}$) of the side portion 34 of the base metal 35 is reduced in order to easily transfer the heat of the heater 37 to the side portion 34 of the base metal 35 through the sleeve 36, the thickness ($t_{B1}$) of the side portion 34 is preferably formed to be thicker than the thickness ($t_S$) of the sleeve 35.

In addition, from an experiment result in which a ratio of the thickness ($t_{B1}$) of the side portion 34 of the base metal 35 to the thickness ($t_S$) of the sleeve 36 was taken as a variable, a more effective thermal conductivity was implemented in case that the thickness ($t_{B1}$) of the side portion 34 of the base metal 35 is below double the thickness ($t_S$) of the sleeve 36.

This is because if the thickness ($t_{B1}$) of the side portion 34 of the base metal 35 exceeds double the thickness ($t_S$) of the sleeve 36, the side portion 34 of the base metal is too thick, so that the thermal conductivity is rather degraded.

Therefore, in order to improve the thermal conductivity, the thickness ($t_{B1}$) of the side portion 34 of the base metal 35 is thicker than the thickness ($t_S$) of the sleeve 36 but does not exceed double the thickness ($t_S$) of the sleeve 36, as shown in the following formula (7):

$$t_S \leqq t_{B1} \leqq 2t_S \tag{7}$$

Meanwhile, as shown in the below Table 1, in an experiment in which the thickness ($t_{B1}$) of the side portion 34 of the base metal 35, the thickness ($t_{B2}$) of the upper surface portion 32 and the thickness ($t_S$) of the sleeve 36 were taken as variables, with respect to the sleeve 36 with the thickness ($t_S$) of 0.021 mm and the side portion 34 of the base metal 35 with the thickness ($t_{B1}$) of 0.05 mm (CASE 1), when the thickness ($t_{B2}$) of the upper surface portion 32 of the base metal 35 is changed from 0.14 mm to 0.162 mm (CASE 2), the warm-up time was delayed by 10%~20%. But in the case of CASE 2, when the thickness ($t_{B1}$) of the side portion 34 of the base metal 35 is reduced from 0.05 mm to 0.03 mm (CASE 3), the warm-up time was the same with the CASE 1.

TABLE 1

| | CASE 1 | CASE 2 | CASE 3 |
|---|---|---|---|
| $t_{B1}$(mm) | 0.05 | 0.05 | 0.03 |
| $t_{B2}$(mm) | 0.14 | 0.162 | 0.162 |
| $t_S$(mm) | 0.021 | 0.021 | 0.021 |
| Warm-up time (%) | 100 | 110~120 | 100 |

That is, the reduction in the thickness ($t_{B1}$) of the side portion 34 of the base metal 35 leads to improvement of the thermal conductivity.

Meanwhile, the thickness ($t_S$) of the sleeve 36 is preferably formed between 0.018 mm and 0.025 mm as shown in the following formula (8). Namely, if the thickness ($t_S$) of the sleeve 36 is thinner than 0.018 mm, it is difficult to fix the base metal 35 to the sleeve 36. If, however, the thickness ($t_S$) of the sleeve 36 is thicker than 0.025 mm, the heat conduction distance (L) is lengthened so that the thermal conductivity is degraded.

$$0.018\ \text{mm} \leqq t_S \leqq 0.025\ \text{mm} \tag{8}$$

The optimum designing of the thickness ($t_{B1}$) of the side portion 34 of the base metal 35 and the thickness ($t_{B2}$) of the upper surface portion 32 will now be described.

In order for the heat transmitted to the side portion 34 of the base metal 35 to be easily transmitted to the electron emissive layer 31 through the upper surface portion 32, the thickness ($t_{B2}$) of the upper surface portion 32 of the base metal 35 is preferably thicker than the thickness ($t_{B1}$) of the side portion 34 of the base metal 35.

At this time, in an experiment in which the thickness ($t_{B1}$) of the side portion 34 of the base metal 35 and the thickness ($t_{B2}$) of the upper surface portion 32 are taken as variables under the condition that the thickness ($t_S$) of the sleeve 36 is 0.018 mm~0.025 mm, it was noted that the thermal conductivity from the side portion 34 of the base metal 35 to the upper surface portion 32 was effective when the ratio ($t_{B2}/t_{B1}$) of the thickness ($t_{B2}$) of the upper surface portion 32 to the thickness ($t_{B1}$) of the side portion 34 of the base metal 35 was in the range of 2.8~7.0.

This is because if the ratio of the thickness ($t_B2$) of the upper surface portion 32 to the thickness ($t_{B1}$) of the side portion 34 of the base metal 35 is smaller than 2.8, an amount of thermal conduction from the side portion 34 toward the upper surface portion 32 is small. If, however, the ratio of the thickness ($t_{B2}$) of the upper surface portion 32 to the thickness ($t_{B1}$) of the side portion 34 is greater than 7.0, the thickness ($t_{B2}$) of the upper surface portion 32 is so thick that the heat transfer distance passing the upper surface portion 32 is lengthened.

Therefore, it is preferred that the ratio ($t_{B2}/t_{B1}$) of the thickness ($t_{B2}$) of the upper surface portion 32 to the thickness ($t_{B1}$) of the side portion 34 of the base metal 35 is in the range of 2.8~7.0 as in the below formula (9):

$$2.8 \leqq t_{B2}/t_{B1} \leqq 7.0 \tag{9}$$

As so far described, the cathode of the cathode ray tube in accordance with the present invention has the following advantage.

That is, by optimizing the combination of the thickness of the side portion and the upper surface portion of the base metal and the thickness of the sleeve in designing, heat generated from the heater of the cathode is quickly transferred to the electron emissive layer. Therefore, the warm-up time taken for formation of an image after power is applied to the cathode ray tube can be shortened.

As the present invention may be embodied in several forms without departing from the spirit or essential characteristics thereof, it should also be understood that the above-described embodiments are not limited by any of the details of the foregoing description, unless otherwise specified, but rather should be construed broadly within is spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube having a cathode, the cathode comprising a sleeve with a heater installed therein and a base metal with a side portion covering an outer circumference of the sleeve and an upper surface portion covering an upper side of the sleeve, satisfies the following formula:

$$t_S \leqq t_{B1} \leqq 2t_S,$$

wherein $t_{B1}$ is a thickness of the side portion of the base metal and $t_S$ is a thickness of the sleeve.

2. The cathode ray tube of claim 1, wherein the thickness $t_S$ of the sleeve satisfies the following formula:

$$0.018 \text{ mm} \leqq t_S \leqq 0.025 \text{ mm}.$$

3. The cathode ray tube of claim 2, wherein when the thickness of the upper surface portion of the base metal is $t_{B2}$, the following formula is satisfied:

$$2.8 \leqq t_{B2}/t_{B1} \leqq 7.0.$$

4. The cathode ray tube of claim 1, wherein when the thickness of the upper surface portion of the base metal is $t_{B2}$, the following formula is satisfied:

$$t_{B2} > t_{B1}.$$

5. The cathode ray tube of claim 4, wherein the thickness $t_S$ of the sleeve satisfies the following formula:

$$0.018 \leqq t_S \leqq 0.025 \text{ mm}.$$

6. The cathode ray tube of claim 5, wherein the thickness $t_{B1}$ of the side portion of the base metal and the thickness $t_{B2}$ of the upper surface portion satisfy the following formula:

$$2.8 \leqq t_{B2}/t_{B1} \leqq 7.0.$$

7. A cathode ray tube having a cathode, the cathode comprising a sleeve with a heater installed therein and a base metal with a side portion covering an outer circumference of the sleeve and an upper surface portion covering an upper side of the sleeve, satisfies the following formula:

$$t_S \leqq t_{B1} \leqq 2t_S, \text{ and } 0.018 \leqq t_S \leqq 0.025 \text{ mm}$$

wherein $t_{B1}$ is a thickness of the side portion of the base metal, the thickness of the upper surface portion is $t_{B2}$, and $t_S$ is a thickness of the sleeve.

8. The cathode ray tube of claim 7, wherein the thickness $t_{B1}$ of the side portion and the thickness $t_{B2}$ of the upper surface portion of the base metal satisfy the following formula:

$$2.8 \leqq t_{B2}/t_{B1} \leqq 7.0.$$

* * * * *